US010533822B1

(12) United States Patent
Popov

(10) Patent No.: US 10,533,822 B1
(45) Date of Patent: Jan. 14, 2020

(54) VERTICAL CROSSBOW

(71) Applicant: Sergey Popov, Moscow (RU)

(72) Inventor: Sergey Popov, Moscow (RU)

( * ) Notice: Subject to any disclaimer, the term of this patent is extended or adjusted under 35 U.S.C. 154(b) by 0 days.

(21) Appl. No.: 16/253,438

(22) Filed: Jan. 22, 2019

(51) Int. Cl.
*F41B 5/12* (2006.01)
*F41B 5/00* (2006.01)

(52) U.S. Cl.
CPC ..... *F41B 5/123* (2013.01); *F41B 5/0094* (2013.01)

(58) Field of Classification Search
CPC ..... F41B 5/0094; F41B 5/12; F41B 5/123
USPC ..... 124/25
See application file for complete search history.

(56) References Cited

U.S. PATENT DOCUMENTS 4,711,228 A * 12/1987 Gillespie ..... F41B 5/123 124/24.1
5,720,268 A * 2/1998 Koltze ..... F41B 5/0094 124/23.1
7,578,289 B2 * 8/2009 Norkus ..... F41B 5/0094 124/25
7,743,760 B2 * 6/2010 Woodland ..... F41B 5/0094 124/25
8,522,762 B2 * 9/2013 Trpkovski ..... F41B 5/0094 124/25.6
8,622,050 B2 * 1/2014 Goff ..... F41B 5/12 124/25
8,671,923 B2 * 3/2014 Goff ..... F41B 5/123 124/25
8,997,728 B2 * 4/2015 Popov ..... F41B 5/0094 124/25.6
9,097,499 B2 * 8/2015 Goehring, III ..... F41B 5/0094
9,234,719 B1 * 1/2016 Kempf ..... F41B 5/105
9,297,604 B1 * 3/2016 Sidebottom ..... F41B 5/123
9,377,267 B1 * 6/2016 Kempf ..... F41B 5/105
9,513,080 B1 * 12/2016 Kempf ..... F41B 5/123
9,518,796 B2 * 12/2016 Carroll, Jr. ..... F41B 5/12
9,879,938 B1 * 1/2018 Isenhower ..... F41B 5/123
10,209,026 B2 * 2/2019 Yehle ..... F41B 5/066
10,267,592 B2 * 4/2019 Bartels ..... F41B 5/123
10,393,470 B1 * 8/2019 Popov ..... F41B 5/123
2019/0178603 A1 * 6/2019 Laurence ..... F41B 5/123

* cited by examiner

*Primary Examiner* — Alexander R Niconovich
(74) *Attorney, Agent, or Firm* — Cantor Colburn LLP

(57) ABSTRACT

A crossbow including a frame along which an arrow movement axis essentially passes, a first holder and a second holder attached to the frame on opposite sides from the arrow movement axis, a first cam and a second cam arranged on the first holder and the second holder, respectively, made rotatable, and located essentially in a horizontal plane, and at least one limb arranged essentially below the arrow movement axis and attached to the frame. The at least one limb having a free end and made bending essentially in a vertical plane when using the crossbow where the vertical plane being perpendicular to the horizontal plane. The crossbow further includes a bowstring connecting the first cam and the second cam and at least one cable connecting the first cam and the second cam to the free end of the at least one limb.

8 Claims, 5 Drawing Sheets

VERTICAL CROSSBOW

FIELD OF THE INVENTION

The present invention relates to devices for shooting arrows, in particular to crossbows.

BACKGROUND OF THE INVENTION

Numerous varieties of crossbows are known, wherein a plane of arrangement and bending of limbs, on one hand, as well as a plane of arrangement of cams and passage of cables and a bowstring, on the other hand, are parallel to each other (or even coincide). When such a crossbow is used for making a shot said planes are located horizontally. This crossbow design is most common, and a typical example is disclosed e.g. in U.S. Pat. No. 9,297,604.

Parallelism or coincidence of the plane of arrangement and bend of limbs and the plane of arrangement of cams and passage of cams and a bowstring results in that transverse dimensions of a crossbow, which are defined mainly by a spread of limbs, are great. A reduction of the spread of limbs causes the necessity of using limbs having low elasticity in order to maintain a high initial speed of an arrow. This causes known difficulties in using the crossbow as well as higher load on components of the crossbow, since a higher force is required for drawing a bowstring.

Also known are crossbows which limbs are located vertically when making a shot. These crossbows have a very small width. This is obtained by arranging limbs, cams, a bowstring and cables in a vertical plane. Examples may be found in U.S. Pat. Nos. 8,622,050 and 8,671,923, which describe the crossbows having the limbs with the cams installed thereon that are arranged in a vertical plane in such a way that the first limb is located below the frame and the second limb is located above the frame. The bowstring and cables connect said cams in the vertical plane too. Said cables cross the crossbow frame, thus creating a friction node lowering an initial speed of an arrow when shooting. The bowstring, when being drawn, is moved along the crossbow frame in the vertical plane. Apparently, this arrangement of the limbs reduces dimensions of the crossbow in width, but significantly increases dimensions in height. Furthermore, a movement of the bowstring in the vertical plane causes inconvenience in placing the arrow and holding such the crossbow.

In fact, the above-described known vertical crossbows do not differ in any way from the crossbows having commonly arranged limbs (i.e. horizontally), and therefore show the same drawbacks as the crossbows with commonly arranged limbs.

SUMMARY OF THE INVENTION

This is an object of the invention to provide a crossbow design where a crossbow has small dimensions both in width and in height. Furthermore, the crossbow should have a simple structure, be convenient in use and provide high initial speed of an arrow.

Said object is achieved thanks to that at least one limb is used in the claimed crossbow which at least partially bends in a vertical plane when using the crossbow. This limb may be located under a frame of the crossbow and may be bent in the vertical plane essentially below the frame. Cams are attached to respective holders and arranged in a horizontal plane which perpendicular to said vertical plane. This ensures minimal width and height of such the crossbow. The width of the crossbow is defined by arrangement of the cams only, while the limbs, depending on an angle of arrangement relative to the frame, do not significantly affect the height of the crossbow. Additionally, this also ensures a high initial speed of an arrow without the necessity of using less elastic limbs.

Cam holders may be made as a single part or at least two parts separate from the frame, or as integral parts of the frame. In an embodiment where the cam holders are made as at least two parts, they may be made of the same material that is used for the limbs, i.e. an elastically deformable material. The cam holders are arranged essentially along the frame and resemble the limbs by their appearance. However, the cam holders may not be called as limbs, since they do not accumulate energy required for a shot, notwithstanding the fact that the cam holders are movable when a bowstring is being drawn.

A bowstring connects a first cam and a second cam and, when being drawn, moves along the frame in the horizontal plane at a level of an arrow movement axis. It allows a shooter to holding a crossbow in a conventional manner, which makes this crossbow convenient in use.

At least one cable connects said first cam and said second cam with a free end of at least one said limb in such a way that it does not form an obstruction for an arrow being shot.

Optionally, rollers may be installed for changing a direction of the at least one cable.

BRIEF DESCRIPTION OF THE DRAWINGS

Further the invention will be explained in more detail with references to the drawings showing possible, but not limiting this invention, embodiments of the crossbow, wherein.

DESCRIPTION OF THE ILLUSTRATED EMBODIMENTS

Figures 1A, 1B:
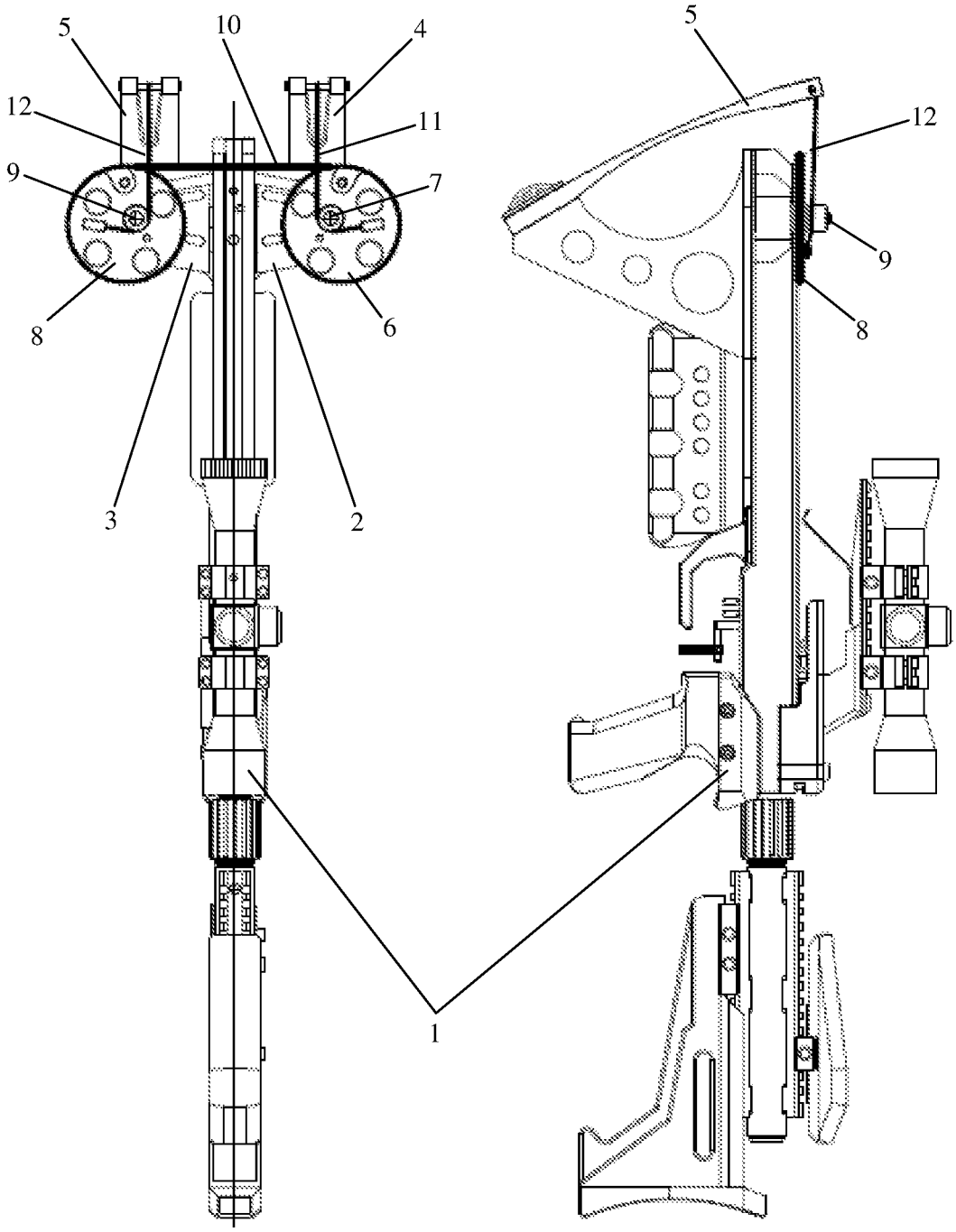
FIGS. 1*a*, 1*b* show an embodiment of the crossbow having two limbs directed forward.

According to the invention, a crossbow comprises a frame 1 to which the following components are attached: a first holder 2, a second holder 3 and at least one limb. Thus, FIGS. 1-4 depict embodiments of a crossbow having two limbs—a first limb 4 and a second limb 5, and FIG. 5 depicts an embodiment of a crossbow having a single limb 15.

At least one limb is attached to the frame 1 with a one end thereof, and a second end of said at least one limb is free. When two limbs are used—the first limb 4 and the second limb 5, the first holder 2 and the first limb 4 are arranged on one side of the frame 1, and the second holder 3 and the second limb 5 are arranged on the other side of the frame 1. The limbs 4, 5, 15 are attached to a lower portion of the frame 1.

A first cam 6, which rotates around a first rotation axle 7, is arranged at an end of the first holder 2. A second cam 8, which rotates around a second rotation axle 9, is arranged at an end of the second holder 3.

The first cam 6 and the second cam 8 are located in a horizontal plane (which is perpendicular to the plane of the figures designated as "a" and parallel to the plane of the figures designated as "b") and are connected by a bowstring 10 used for imparting an initial speed to an arrow (not shown in the figures).

The free end of the first limb 4 and the first cam 6 are connected with a first cable 11. The free end of the second limb 5 and the second cam 8 are connected with a second cable 12.

When the bowstring 10 is being drawn, the cams 6, 8 start rotating around the axles 7, 9, thus causing wrapping of the cables 11, 12 onto the cams 6, 8. In turn, wrapping of the cables 11, 12 onto the cams 6, 8 causes bending of the limbs 4, 5, 15 and accumulation of energy therein. When the bowstring 10 is released, the cams 6, 8 rotate in the opposite direction, wherein a rotation speed thereof is defined by said bending of the limbs 4, 5, 15 and directly affects the initial speed of an arrow.

Figures 2A, 2B:
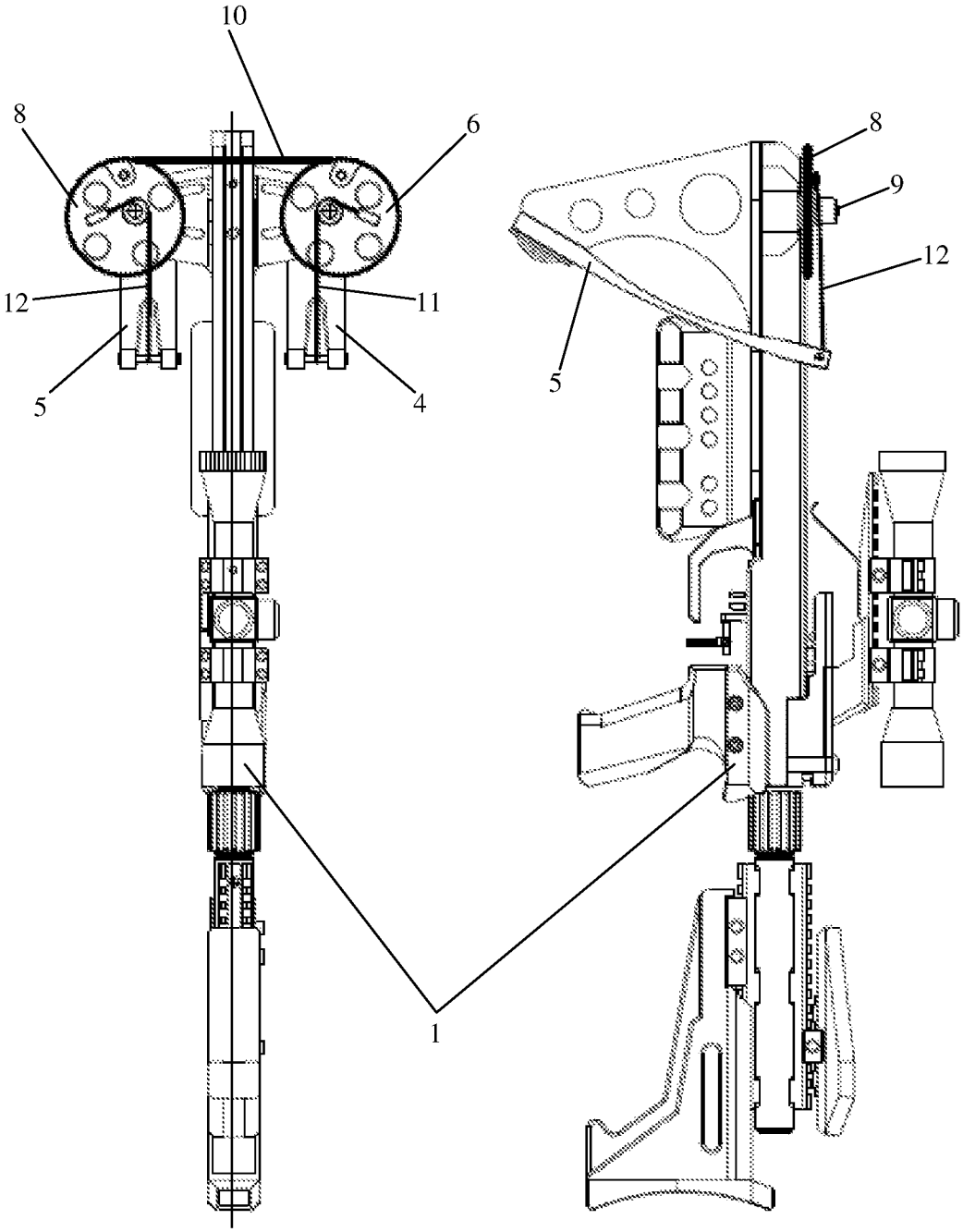
FIGS. 2*a*, 2*b* show an embodiment of the crossbow having two limbs directed rearward.
Figures 3A, 3B:
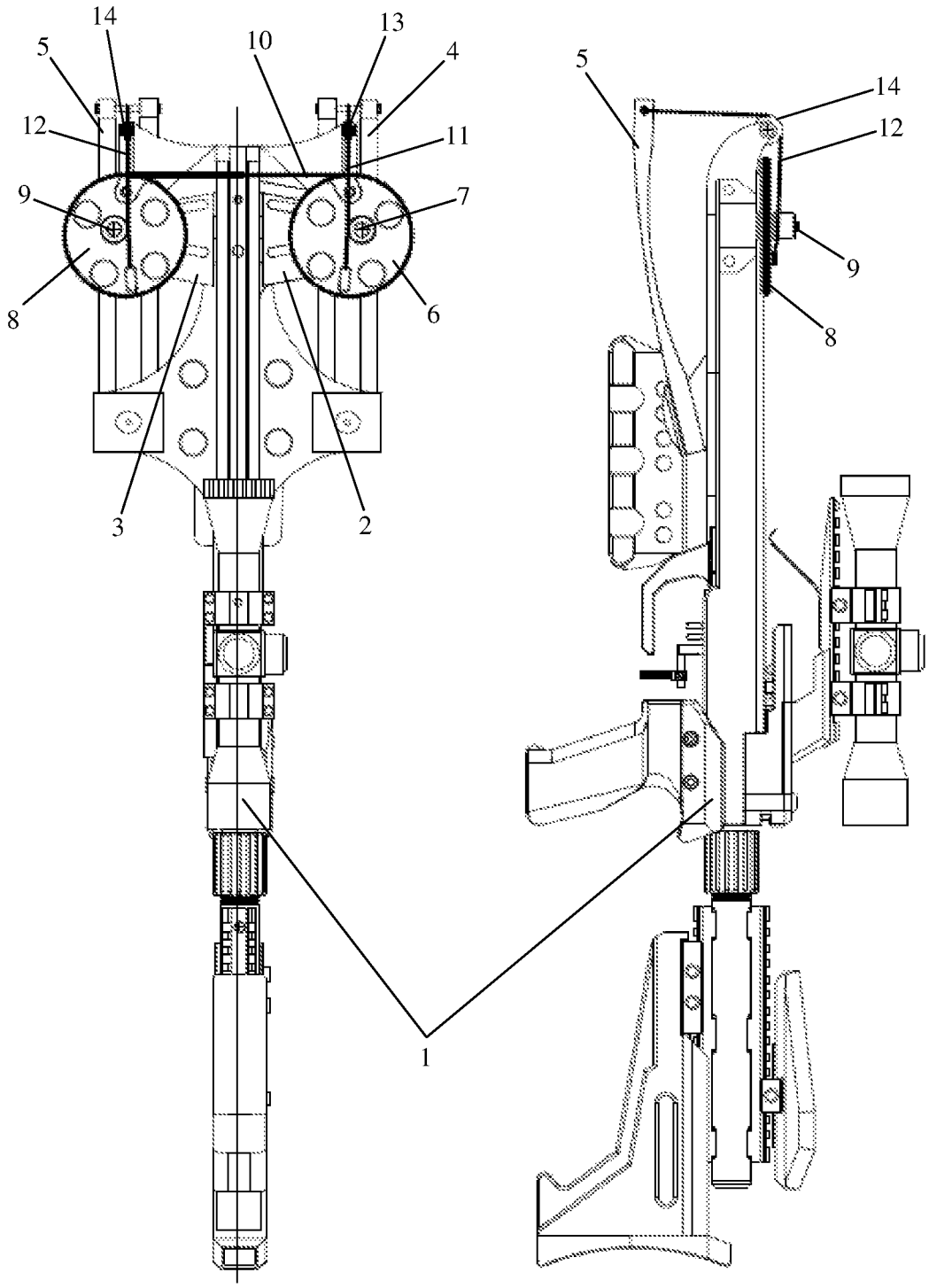
FIGS. 3*a*, 3*b* show an embodiment of the crossbow having rollers intended for changing cable directions.

The limbs 4, 5, 15 may be directed forward with their free ends, i.e. in the direction of an arrow movement axis during a shot, as shown in FIGS. 1, 3, 5. In another embodiment, the limbs 4, 5, 15 may be directed rearward with their free ends, i.e. opposite to the direction of the arrow movement axis, e.g. as shown in FIG. 2 for the limbs 4, 5. Yet in another embodiment, the limbs 4, 5 may be directed with their free ends to the sides from the frame 1, as shown in FIG. 3.

Figures 4A, 4B:
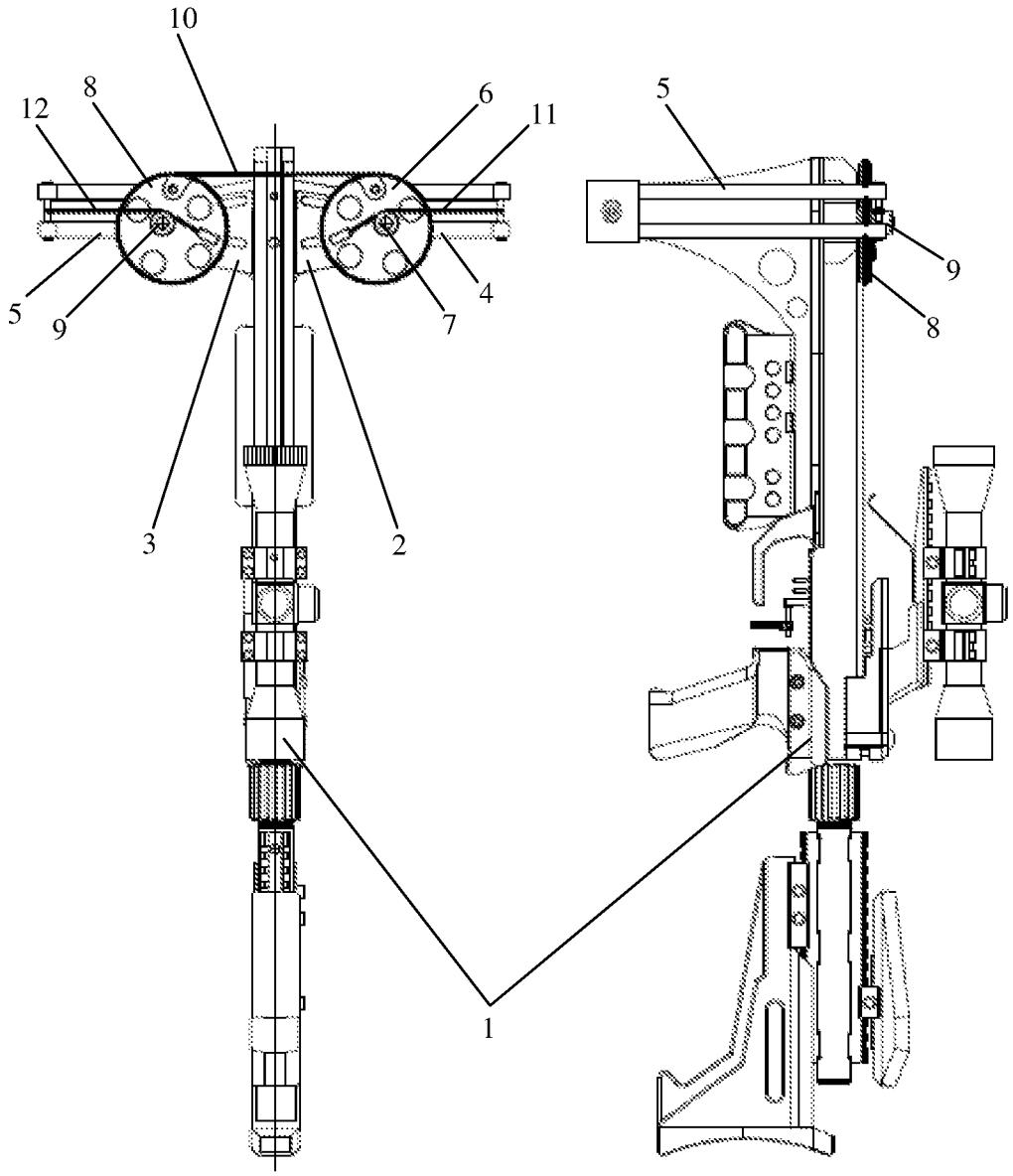
FIGS. 4*a*, 4*b* show an embodiment of the crossbow having two limbs directed to sides.
Figures 5A, 5B:
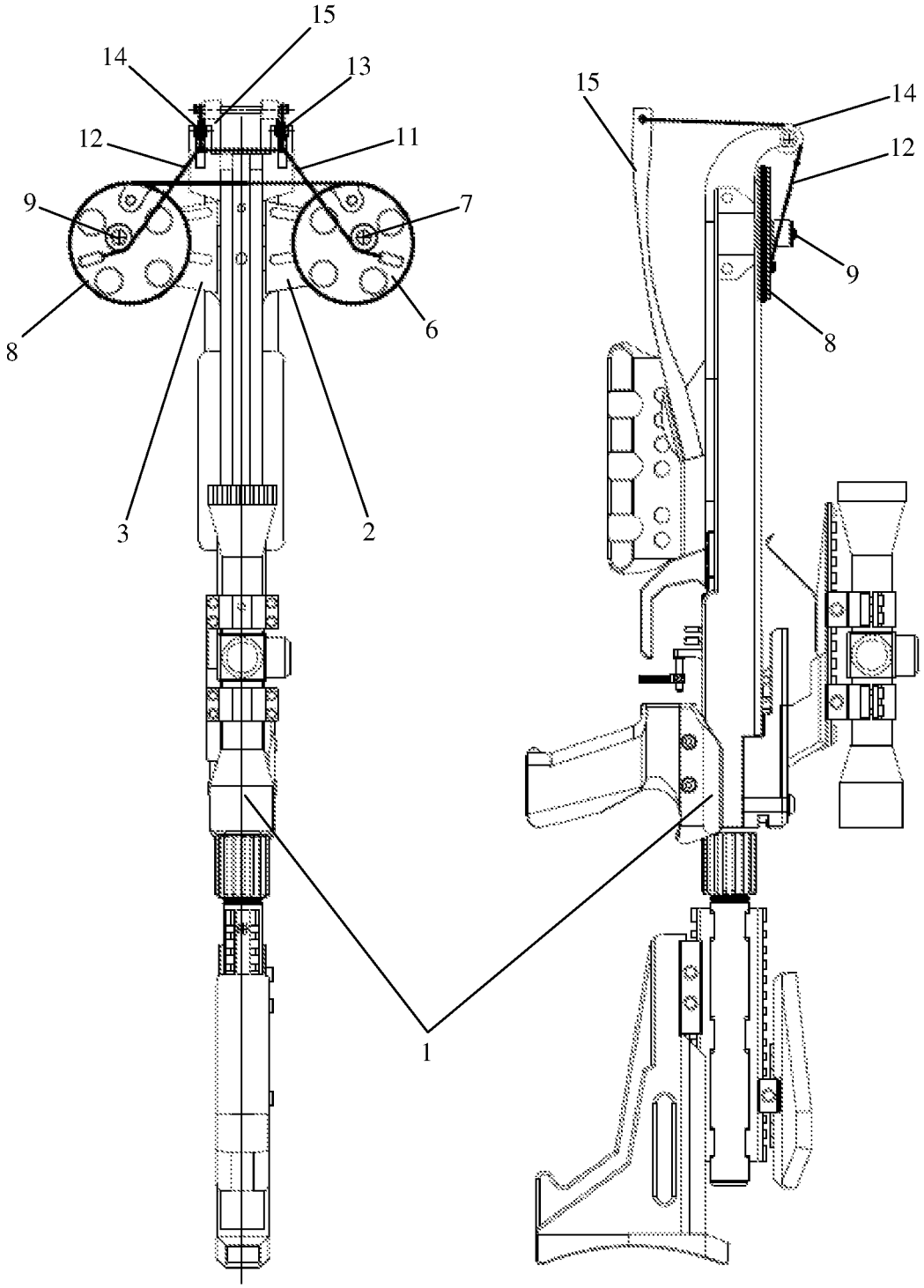
FIGS. 5*a*, 5*b* show an embodiment of the crossbow having a single limb directed forward.

Arrangement of the limbs 4, 5, 15 relative to the frame 1 may be either nearly horizontal, as shown e.g. in FIGS. 3, 5, thus making the crossbow compact, or angular, as shown in FIGS. 1, 2, 4, especially if the limbs 4, 5, 15 are compact themselves.

Important is that in any of the above embodiments and arrangements of the limbs 4, 5, 15, when the bowstring 10 is being drawn and, consequently, the cables 11, 12 are wrapped onto the cams 6, 8, the limbs 4, 5, 15 are bent essentially in a vertical plane (which is parallel to the plane of the figures designated as "a" and perpendicular to the plane of the figures designated as "b"), which is perpendicular to the above-mentioned horizontal plane.

The proposed crossbow design where the limbs 4, 5, 15 are bent essentially in the vertical plane enables to significantly reduce dimensions of the crossbow without changing the length of the limbs 4, 5, 15.

The free ends of the limbs 4, 5, 15 may rise above the arrow movement axis, as shown in FIGS. 1, 2, 4, and then the cables 11, 12 pass from the free ends to the cams 6, 8 without bending.

Alternatively, the free ends of the limbs 4, 5, 15 may be located below the arrow movement axis, as shown in FIGS. 3, 5, and then a need arises of installing rollers that will direct the cables 11, 12 to the cams 6, 8. For example, FIGS. 3, 5 show a first roller 13 and a second roller 14 over which the cables 11, 12 pass from the free ends of the limbs 4, 5, 15 to the cams 6, 8.

Those skilled in the art will understand that the two cables 11, 12 may be replaced by a single cable connecting the first cam 6 and the second cam 8 and passing through the free ends of the limbs 4, 5, 15. Though it may result in losing some energy due to friction arising in locations where the cable passes over the free ends of the limbs 4, 5, 15, the use of a single cable is preferable for maintaining similar tension of a portion of the cable between the first cam 6 and the free ends of the limbs 4, 5, 15 and of a portion of the cable between the second cam 8 and the free ends of the limbs 4, 5, 15.

The limbs 4, 5, 15 may be made as a single piece or consist of two or more portions.

The first holder 2 and the second holder 3 may be made either immovable during drawing the bowstring 10 (i.e. rigid), or movable during drawing the bowstring 10 (i.e. elastic). It is also possible to make the first holder 2 and the second holder 3 as separate parts or as a single part, either integrated with the frame 1 or separated from the frame 1.

Taking the above description as the basis, those skilled in the art will understand that many other embodiments of the claimed invention are possible, wherein the planes of bending the limbs and the plane of arranging the cams are perpendicular to each other.

What is claimed is:

1. A crossbow, comprising:

a frame along which an arrow movement axis essentially passes;

a first holder and a second holder attached to the frame on opposite sides from the arrow movement axis, said first holder and second holder extending from said frame;

a first cam and a second cam arranged at an end of the first holder and at an end of the second holder, respectively, the first cam and the second cam disposed in a horizontal plane and arranged to be rotatable in said horizontal plane;

at least one limb arranged essentially below the arrow movement axis and attached to the frame, said least one limb having a free end and made bending essentially in a vertical plane when using the crossbow, said vertical plane being perpendicular to said horizontal plane;

a bowstring connecting the first cam and the second cam and laying in said horizontal plane; and at least one cable connecting the first cam and the second cam to the free end of said at least one limb.

2. The crossbow of claim 1, wherein said at least one limb comprises two or more limb portions.

3. The crossbow of claim 1, wherein the first holder and the second holder are made immovable when drawing the bowstring.

4. The crossbow of claim 1, wherein the first holder and the second holder are made movable when drawing the bowstring.

5. The crossbow of claim 1, wherein the first holder and the second holder are made integral with the frame.

6. The crossbow of claim 1, wherein the first holder and the second holder are made as parts separated from the frame.

7. The crossbow of claim 1, wherein the first holder and the second holder are made as a single part.

8. The crossbow of claim 1, further comprising rollers for directing said at least one cable.

* * * * *